US006389926B1

(12) United States Patent
Bortolon

(10) Patent No.: US 6,389,926 B1
(45) Date of Patent: May 21, 2002

(54) ADJUSTABLE PEDAL-INTEGRATED CABLE TRANSFER

(75) Inventor: Chris Bortolon, Clawson, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/671,462

(22) Filed: Sep. 27, 2000

(51) Int. Cl.[7] ..... G05G 1/14
(52) U.S. Cl. ..... 74/512; 74/560; 74/502.4
(58) Field of Search ..... 74/512, 513, 501.5 R, 74/500.5, 560, 474, 478, 502.4; 192/111 A

(56) References Cited

U.S. PATENT DOCUMENTS

| | | | | | |
|---|---|---|---|---|---|
| 3,643,524 A | * | 2/1972 | Herring | ..... | 74/512 |
| 3,975,972 A | * | 8/1976 | Muhleck | ..... | 74/560 |
| 4,245,713 A | * | 1/1981 | Mochida et al. | ..... | 180/176 |
| 5,014,831 A | * | 5/1991 | Wawra et al. | ..... | 192/4 A |
| 5,611,249 A | * | 3/1997 | Perisho et al. | ..... | 74/512 |
| 5,913,946 A | | 6/1999 | Ewing | ..... | 74/513 |
| 5,979,622 A | * | 11/1999 | Daniel | ..... | 192/3.63 |
| 6,164,154 A | * | 12/2000 | Munger et al. | ..... | 74/512 |
| 6,209,417 B1 | * | 4/2001 | Munger et al. | ..... | 74/512 |

FOREIGN PATENT DOCUMENTS

| | | | | |
|---|---|---|---|---|
| WO | WO 94/18462 | * | 8/1994 | ..... 74/512 |
| WO | WO 94/18469 | * | 8/1994 | ..... 74/512 |

* cited by examiner

*Primary Examiner*—Vinh T. Luong
(74) *Attorney, Agent, or Firm*—Howard and Howard

(57) ABSTRACT

A second conduit (30) is disposed in parallel relationship with a first conduit (28) with both extending between the legs (13) of a support bracket (12) with a first ends (32 and 34) attached to an adjustment member (16) for movement therewith along a rod (14) during the adjustment of a pedal lever (18) between the operational positions. The assembly is characterized by the second ends (45) of the conduits being attached directly to the support bracket (12) instead of being attached to the vehicle structure. A plunger (46) is slidably supported by the support bracket and a cross bar (50) is attached to the plunger (46) to extend transversely thereto. The core elements (40 and 42) are attached to the cross bar (50) on opposite sides of the plunger (46).

16 Claims, 2 Drawing Sheets

ADJUSTABLE PEDAL-INTEGRATED CABLE TRANSFER

BACKGROUND OF THE INVENTION

1. Field of the Invention

An adjustable pedal assembly of the type utilized in an automotive vehicle to adjust the operating position of the clutch, brake or throttle pedals.

2. Description of the Prior Art

The prior art adjustable pedal assemblies generally include a support bracket adapted for attachment to a vehicle structure with an adjustment member movably supported by the support bracket for adjustment between various operational positions and a pedal lever rotatably supported by the adjustment member for rotation about a pivot axis during normal operation by application of an operator force. The adjustment member may be supported on a rod or by parallel-type linkage.

In some assemblies, a conduit has a first end attached to the adjustment member for movement therewith during the adjustment between the operational positions and extends to a second end that is supported by the vehicle structure. A motion transmitting core element is slidably supported by the conduit and has a first end extending from the first end of the conduit and operatively attached to the pedal lever. A second end of the core element extends from the second end of the conduit for attachment to a control member for transmitting motion from the pedal lever to the control member. Examples of such assemblies are disclosed in U.S. Pat. No. 5,913,946 to Ewing; U.S. Pat. No. 6,164,154 to Munger et al.; U.S. Pat. No. 6,209,417 to Munger et al. and Ser. No. 09/409,512 to Bortolon, now abandoned. These assemblies require the attachment of the second ends of the conduit and core element, which are free and loose during shipment to the vehicle assembly line, upon installation of the adjustable pedal assembly in the vehicle.

SUMMARY OF THE INVENTION AND ADVANTAGES

An adjustable pedal assembly comprising a support bracket adapted for attachment to a vehicle structure and an adjustment member movably supported by the support bracket for adjustment between various operational positions. A pedal lever is rotatably supported by the adjustment member for rotation about a pivot axis. A conduit has a first end attached to the adjustment member for movement therewith during the adjustment between the operational positions and extends to a second end. A motion transmitting core element is slidably supported by the conduit and has a first end extending from the first end of the conduit and operatively attached to the pedal lever and a second end extending from said second end of the conduit for attachment to a control member for transmitting motion from the pedal lever to the control member. The assembly is characterized by the second end of the conduit being attached to support bracket.

Accordingly, the assembly may be shipped with the end of the conduit connected and ready for the support bracket to be attached to a vehicle structure and the control member to be connected to the member to be controlled.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
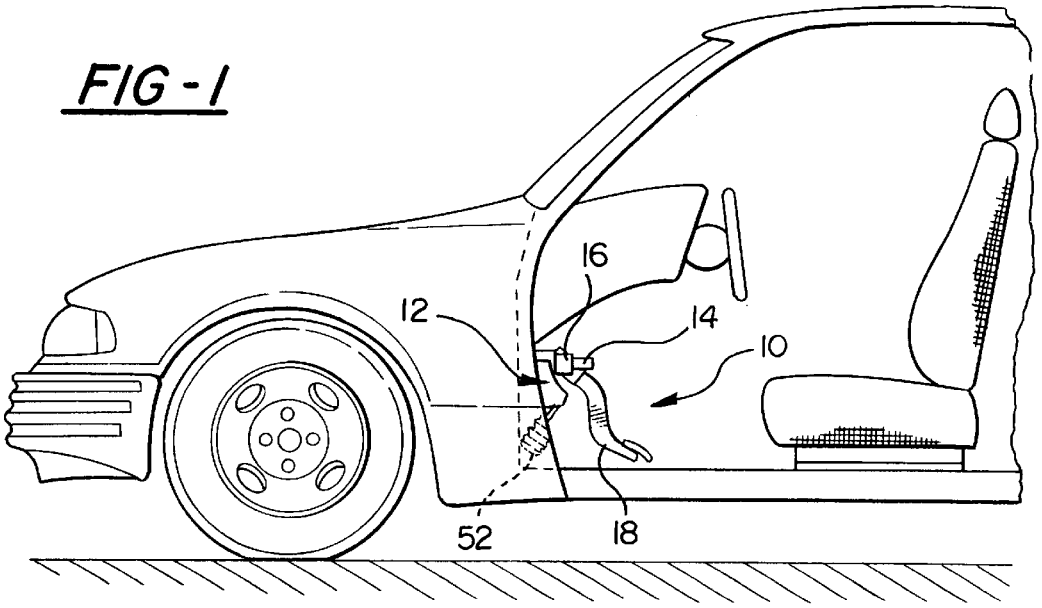
FIG. 1 is an environmental view showing a preferred embodiment in an automotive vehicle.

Referring to the Figures, an adjustable pedal assembly constructed in accordance with the subject invention is generally shown at 10.

The assembly 10 includes a support bracket, generally indicated at 12, adapted for attachment to a vehicle structure 15, such as the firewall. The support bracket 12 is box-shaped in cross section defining a pair of spaced legs or sides 13. The support bracket 12 also includes an attachment device, such as the holes and bolts 11, adapting the support bracket 12 for attachment to the vehicle structure 15. The support bracket 12 also includes a rod 14 and an adjustable member 16 is slidably supported on the rod 14, the rod 14 being rigidly connected, as by welding, to the back wall of the box-shaped bracket 12.

A pedal lever 18 is rotatably supported by the adjustment member 16 for rotation about a pivot axis or pin 20. The pedal lever 18 has an upper end pivotally attached to the adjustment member by the pin 20 and a lower end supporting a pad 22 supported on the lower end of the pedal lever 18 for being engaged by a vehicle operator. Accordingly, the adjustment member 16 is movably supported by the support bracket 12 for adjustment between various operational positions such as these shown in FIGS. 2 and 3. A drive device including a screw 24 is included for moving the adjustment member 16 on the rod 14. This drive device is of the type well known in the art and used in applicant's prior U.S. Pat. No. 5,890,399.

The adjustment member 16 includes an extension 26 extending transversely to the pedal lever 18 and the rod 14, i.e., perpendicular to and laterally of both the pedal lever 18 and the rod 14. A pair of first 28 and second 30 conduits have first ends 32 and 34 thereof attached to the extension 26 of the adjustment member 16 for movement therewith during the adjustment between the operational positions, i.e., as the adjustment member 16 moves between adjusted positions along the rod 14. The conduits 28 and 30 extend to respective second ends 36 and 38 and the assembly 10 is characterized by the second ends 36 and 38 of the conduits 28 and 30 being attached to the support bracket 12.

First 40 and second 42 motion transmitting core elements are slidably supported by the conduits 28 and 30 and extend from the first ends 32 and 34 of the conduits 28 and 30. A projection 44 is rigidly secured to and extends laterally from the pedal lever 18 and first ends of the first 40 and second 42 core elements are attached to the projection 44 in laterally side by side relationship to one another thereby being operatively attached to the pedal lever 18. The first 40 and second 42 motion transmitting core elements have second ends 45 extending from the second end 36 and 38 of the conduits 28 and 30 for attachment to a control member or plunger 46 for transmitting motion from the pedal lever 18 to the plunger 46.

The plunger 46 is movably supported by the bottom of the support bracket 12 for transmitting motion to a member to be controlled (not shown), such as the clutch of an automotive vehicle. The plunger 46 is supported in a bushing 48 disposed in a hole in the bottom wall of the support bracket 12 whereby the plunger 46 has an axis (A) of movement back and forth through the bushing 48. A cross bar 50 is attached to the plunger 46 to extend transversely across one end thereof, the other end of the plunger 46 being housed in a bellows 52 and is adapted for connection to a clutch mechanism, or the like. The first end second core elements 40 and 42 are attached to the cross bar 50 on opposite sides of the axis of the plunger 46 to balance loads on the plunger 46.

Figure 2:
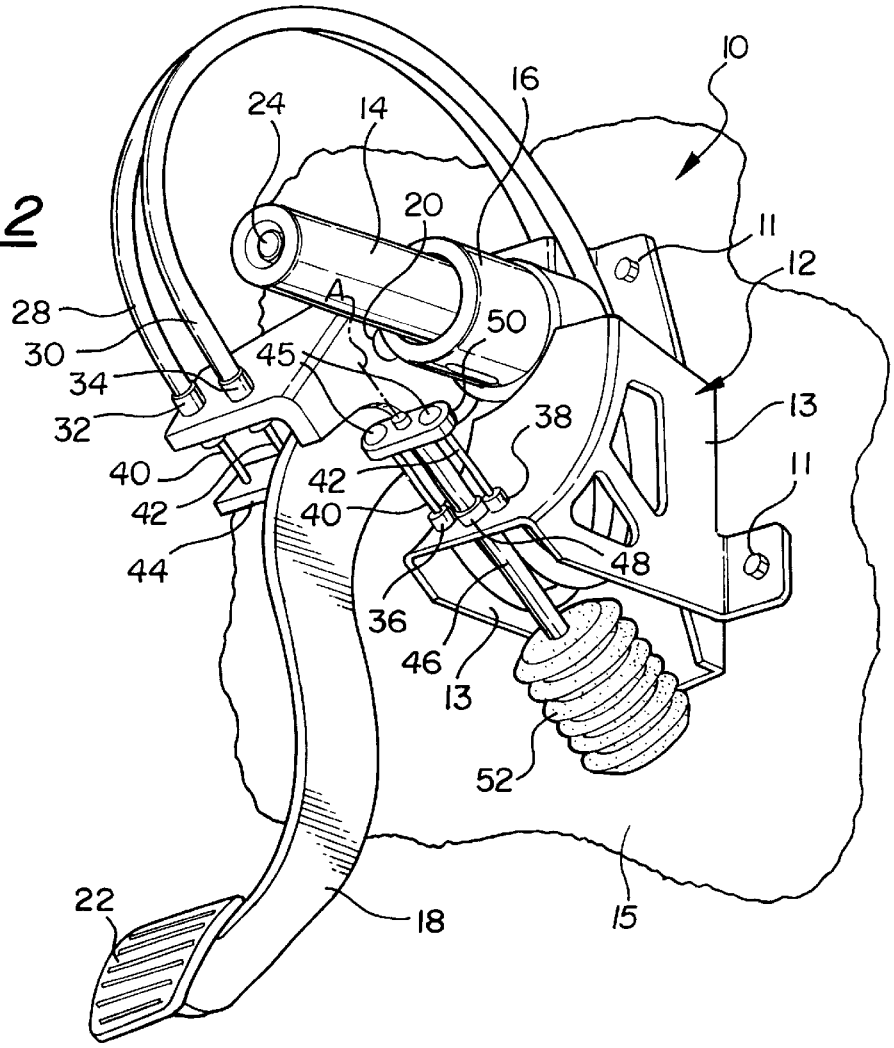
FIG. 2 is a perspective view of the preferred embodiment of the invention.
Figure 3:
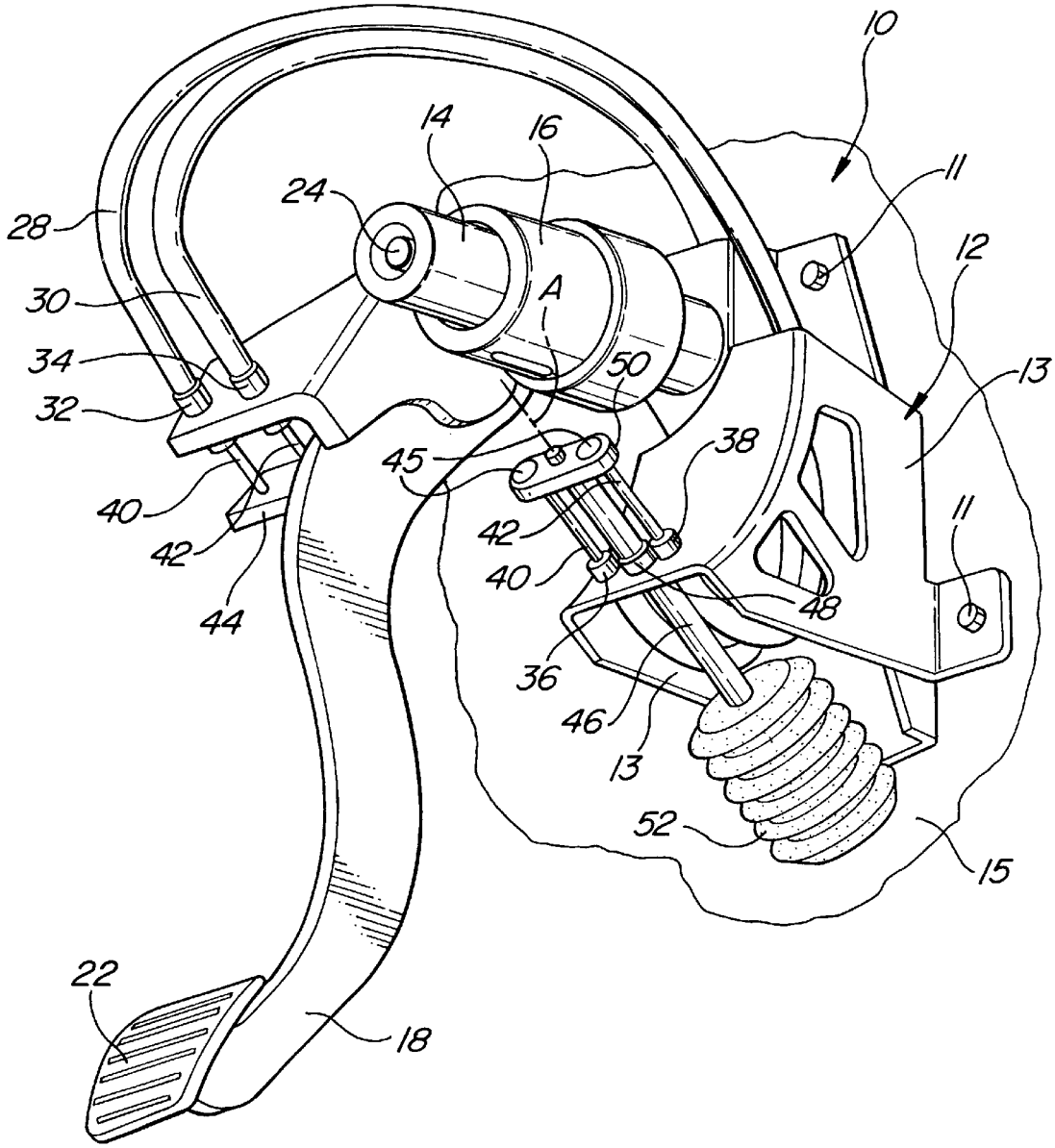
FIG. 3 is a view like FIG. 2 but showing a different adjusted position.

The second conduit 30 is disposed in parallel relationship with the first mentioned conduit 28 with both extending between the legs 13 of the support bracket 12 with a first end 34 attached to the adjustment member 16 for movement therewith during the adjustment between the operational positions of FIGS. 2 and 3 and a second end 36 and 38 attached to the support bracket 12. The second a motion transmitting core element 42 is slidably supported by the second conduit 30 and has a first end extending from the first end 34 of the second end 45 extending from the second end 38 of the second conduit 30 and attached to the plunger 46 defining the control member for transmitting motion from the pedal lever 18 to the control member 46.

Although the assembly has been illustrated with two parallel conduits and core elements, it is just as satisfactory to employ one conduit and core element with the second end of the conduit attached to the support bracket 12.

Accordingly, the assembly 10 may be shipped with the first 32 and 34 and second 36 and 38 ends of the conduits 28 and 30 connected and ready for the support bracket 12 to be attached to a vehicle structure and the control member 46 to be connected to the member (not shown) to be controlled.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An adjustable pedal assembly comprising;

a support bracket (12) including at least one attachment device (11) for attachment to a vehicle structure (15), an adjustment member (16) movably supported by said support bracket (12) for adjustment between various operational positions, a pedal lever (18) rotatably supported by said adjustment member (16) for rotation about a pivot axis (20), a conduit (28 or 30) having a first end (32 or 34) attached to said adjustment member (16) for movement therewith during said adjustment between said operational positions and extending to a second end (36 or 38), a motion transmitting core element (40 or 42) slidably supported by said conduit (28 or 30) and having a first end (32 or 34) extending from said first end (32 or 34) of said conduit (28 or 30) and operatively attached to said pedal lever (18) and a second end (36 or 38) extending from said second end (36 or 38) of said conduit (28 or 30) for transmitting motion from said pedal lever (18), said assembly characterized by said second end (36 or 38) of said conduit (28 or 30) being attached to said support bracket (12) for movement with said support bracket (12) prior to attachment by said attachment device (11).

2. An assembly as set forth in claim 1 including a control member (46) attached to said second end (36 or 38) of said core element (40 or 42) and movably supported by said support bracket (12) for transmitting motion.

3. An assembly as set forth in claim 2 wherein said control member (46) comprises a plunger (46) slidably supported by said support bracket (12) and a cross bar (50) attached to said plunger (46) to extend transversely thereto, said core element (45) being attached to said cross bar (50).

4. An assembly as set forth in claim 3 including a projection (44) extending laterally from said pedal lever (18) and said first end (32 or 34) of said core element (40 or 42) being attached to said projection (44).

5. An assembly as set forth in claim 4 wherein said support bracket (12) includes a rod (14) and said adjustable member (16) is slidably supported on said rod (14).

6. An assembly as set forth in claim 5 wherein said adjustment member (16) includes an extension (26) extending transversely to said pedal lever (18) and said rod (14), said first end (32 or 34) of said conduit (28 or 30) being attached to said extension (26).

7. An adjustable pedal assembly comprising;

a support bracket (12) including at least one attachment device (11) for attachment to a vehicle structure (15), an adjustment member (16) movably supported by said support bracket (12) for adjustment between various operational positions, a pedal lever (18) rotatably supported by said adjustment member (16) for rotation about a pivot axis (20), a conduit (28 or 30) having a first end (32 or 34) attached to said adjustment member (16) for movement therewith during said adjustment between said operational positions and extending to a second end (36 or 38), a motion transmitting core element (40 or 42) slidably supported by said conduit (28 or 30) and having a first end (32 or 34) extending from said first end (32 or 34) of said conduit (28 or 30) and operatively attached to said pedal lever (18) and a second end (36 or 38) extending from said second end (36 or 38) of said conduit (28 or 30) for transmitting from said pedal lever (18), said assembly characterized by said second end (36 or 38) of said conduit (28 or 30) being attached to said support bracket (12), a control member (46) attached to said second end (36 or 38) of said core element (40 or 42) and movably supported by said support bracket (12) for transmitting motion, a second conduit (28 or 30) disposed in parallel relationship with said first mentioned conduit (28 or 30) with a first end (32 or 34) attached to said adjustment member (16) for movement therewith during said adjustment between said operational positions and a second end (36 or 38) attached to said support bracket (12), a second motion transmitting core element (42) slidably supported by said second conduit (28 or 30) and having a first end (32 and 34) extending from said first end (32 and 34) of said second conduit (28 or 30) and operatively attached to said pedal lever (18) and a second end (45) extending from said second end (36 or 38) of said second conduit (28 or 30) and attached to said control member (46) for transmitting motion from said pedal lever (18) to said control member (46).

8. An assembly as set forth in claim 7 wherein said first and second core elements (40 or 42) are attached to on opposite sides of said control member (46) to balance loads on said control member (46).

9. An assembly as set forth in claim 8 wherein said support bracket (12) is box-shaped in cross section defining a pair of spaced legs (13) and said first and second conduits (28 or 30) extend between said legs (13).

10. An assembly as set forth in claim 9 wherein said control member (46) comprises a plunger (46) slidably supported by said support bracket (12) and a cross bar (50) attached to said plunger (46) to extend transversely thereto, said core elements (45) being attached to said cross bar (50) on opposite sides of said plunger (46).

11. An assembly as set forth in claim 9 including a projection (44) extending laterally from said pedal lever (18) and said first ends (32 or 34) of said first and second core elements (40 or 42) being attached to said projection (44) in laterally side by side relationship to one another.

12. An assembly as set forth in claim 9 wherein said support bracket (12) includes a rod (14) and said adjustable member (16) is slidably supported on said rod (14).

13. An assembly as set forth in claim 12 wherein said adjustment member (16) includes an extension (26) extending transversely to said pedal lever (18) and said rod (14), said first ends (32 or 34) of said conduits (28 or 30) being attached to said extension (26).

14. An assembly as set forth in claim 13 wherein said pivotal connection includes a pin (20) interconnecting said adjustment member (16) and said pedal lever (18).

15. An assembly as set forth in claim 14 including a drive device (24) for moving said adjustment member (16) along said rod (14).

16. An assembly as set forth in claim 15 wherein said pedal lever (18) has an upper end pivotally attached to said adjustment member (16) by the pin (20) and a lower end and including a pad (22) supported on said lower end of said pedal lever (18) for being engaged by a vehicle operator.

* * * * *